US011028984B2

(12) United States Patent
Conway

(10) Patent No.: US 11,028,984 B2
(45) Date of Patent: Jun. 8, 2021

(54) LIGHTED REINFORCED LANDSCAPE STRUCTURE

(71) Applicant: Todd Conway, Sandy, UT (US)

(72) Inventor: Todd Conway, Sandy, UT (US)

( * ) Notice: Subject to any disclaimer, the term of this patent is extended or adjusted under 35 U.S.C. 154(b) by 87 days.

(21) Appl. No.: 16/565,251

(22) Filed: Sep. 9, 2019

(65) Prior Publication Data

US 2020/0080693 A1 Mar. 12, 2020

Related U.S. Application Data

(60) Provisional application No. 62/728,719, filed on Sep. 7, 2018.

(51) Int. Cl.

| | |
|---|---|
| ***F21S 8/00*** | (2006.01) |
| ***F21V 15/01*** | (2006.01) |
| ***F21S 4/26*** | (2016.01) |

(52) U.S. Cl.

CPC ..... *F21S 8/032* (2013.01); *F21S 4/26* (2016.01); *F21V 15/013* (2013.01)

(58) Field of Classification Search

CPC ..... F21S 8/032; F21S 4/26; F21V 15/013
See application file for complete search history.

(56) References Cited

U.S. PATENT DOCUMENTS

| | | | |
|---|---|---|---|
| 2,920,184 A | 4/1956 | Kessler | |
| 4,758,934 A | 7/1988 | Von Kohorn | |
| 6,123,443 A | 9/2000 | Conway | |
| 6,449,897 B1 | 9/2002 | Gaston | |
| 6,666,616 B2 | 12/2003 | Yodock, III et al. | |
| D487,932 S | 3/2004 | Crooks | |
| 6,712,546 B1 * | 3/2004 | Radu, Jr. | B28B 7/0014 404/8 |

(Continued)

FOREIGN PATENT DOCUMENTS

| | | |
|---|---|---|
| CA | 2476893 | 8/2003 |

OTHER PUBLICATIONS

Kwik Kerb Eurostyle Landscape Lighting and Curb lighting http://www.kwikerb.org/kerblight.htm.

*Primary Examiner* — Anne M Hines
(74) *Attorney, Agent, or Firm* — Morriss O'Bryant Compagni Cannon, PLLC

(57) ABSTRACT

A landscape assembly having a plurality of curbing sections, each curbing section may include: a front surface and a rear surface forming an interior cavity, a plurality of supports positioned within the interior cavity and providing vertical and radial support to the front and rear surfaces, a channel integral with the rear surface and extending along an entire length of the curbing section, a first end wall connected to a first terminating end of the front and rear surfaces, a second end wall connected to a second terminating end of the front and rear surfaces, the first and second end walls enclosing the interior cavity, and a plurality of spikes extending substantially downward from the curbing section. Each of the plurality of curbing sections may also include a set of interlocking engagement features including: a first interlocking engagement feature and a second interlocking engagement feature disposed on the first and second end walls, respectively, said set of interlocking engagement features being configured to interlock one of the plurality of curbing sections with an immediately adjacent curbing section.

55 Claims, 9 Drawing Sheets

(56) References Cited

U.S. PATENT DOCUMENTS

| | | | | |
|---|---|---|---|---|
| 7,347,606 | B1 * | 3/2008 | Patten | F21V 15/013 362/152 |
| 7,908,792 | B2 * | 3/2011 | Heighton | F21V 33/006 47/33 |
| 9,578,812 | B2 | 2/2017 | Moita | |
| 10,064,348 | B1 * | 9/2018 | Borras | A01G 25/00 |
| 10,557,600 | B1 * | 2/2020 | South | F21S 8/022 |
| 2017/0030538 | A1 | 2/2017 | Geisler et al. | |

* cited by examiner

LIGHTED REINFORCED LANDSCAPE STRUCTURE

CROSS-REFERENCE TO RELATED APPLICATIONS

This application claims the benefit of U.S. Provisional Application No. 62/728,719, filed Sep. 7, 2018, which is hereby incorporated by reference herein in its entirety, including but not limited to those portions that specifically appear hereinafter. This incorporation by reference being made with the following exception: In the event that any portion of the above-referenced provisional application is inconsistent with this application, this application supercedes said above-referenced provisional application.

STATEMENT REGARDING FEDERALLY SPONSORED RESEARCH OR DEVELOPMENT

Not Applicable.

BACKGROUND

1. The Field of the Invention

The present invention relates generally to landscape curbing and flatwork. More particularly, it concerns ornamental landscape curbing and flatwork which projects lighting outwardly therefrom.

2. Description of Related Art

It is common practice in the field of ornamental curbing to place curbstone in lawns and garden areas, particularly in housing areas where, for example, a planting bed of flowers and shrubbery might be separated from a lawn area by a border of curbing. The curbing can act as a divider to prevent lawn from spreading into the planting bed. Ornamental curbing often has a downwardly sloping frontal section which levels off in a kind of ledge surface to accommodate a lawnmower wheel thereupon, which permits the mower to cut the lawn close to the curbing edge, thus avoiding the need for edging.

It has become popular to illuminate lawn and garden areas with lighting, and some attempts have been made to combine the effect of lighting with ornamental curbing. However, often these conventional ornamental curbing systems are characterized by several disadvantages. For example, the lighting structures are unsheathed and can be more easily damaged during installation or removal. The delicate nature of the lighting requires cumbersome and expensive receiving and housing structure for the lighting in order to prevent the lighting from breaking. The lighting structure is not conveniently removable or interchangeable, and fails to provide any option in lighting spacing other than a discontinuous array of unconnected light bulbs and produces discontinuous beams of projecting light. Additionally, curbing is often very heavy, often made of cement, that therefore, difficult to move or adjust.

It is therefore an object of the present invention to provide lighted curbing which is simple in design and manufacture.

It is another object of the present invention, in accordance with one aspect thereof, to provide such lighted curbing wherein the lighting is easier to remove and install and with reduced risk of breaking the lighting.

It is a further object of the present invention, in accordance with one aspect thereof, to provide lighted curbing wherein the is light weight and flexible and more durable.

It is an additional object of the present invention, in accordance with one aspect thereof, to provide lighted curbing wherein the lighting is spaced to achieve a substantially continuous array of projecting light.

The above objects and others not specifically recited are realized in a specific illustrative embodiment of an apparatus and method of lighted ground curbing, flatwork and other structures having a recessed channel formed therein for receiving a length of flexible sheathed lighting. The lighting is recessed within the curbing and adequately protected by the curbing, flatwork or other structure, and is powered by a power source residing separately and independently of the curbing, to thereby eliminate any need for electrical sockets or protective covering to be included as part of the curbing or flatwork portion. The lighting operates to project a substantially continuous stream of light extending continuously along the recess formed in the curbing, flatwork or other structure.

Despite the advantages of known landscape curbing systems, improvements are still being sought. The prior art is characterized by several disadvantages that are addressed by the present disclosure. The present disclosure minimizes, and in some aspects eliminates, the above-mentioned failures, and other problems, by utilizing the methods and structural features described herein.

The features and advantages of the present disclosure will be set forth in the description which follows, and in part will be apparent from the description, or may be learned by the practice of the present disclosure without undue experimentation. The features and advantages of the present disclosure may be realized and obtained by means of the instruments and combinations particularly pointed out in the appended claims. Any discussion of documents, acts, materials, devices, articles or the like which has been included in the present specification is not to be taken as an admission that any or all of these matters form part of the prior art base, or were common general knowledge in the field relevant to the present disclosure as it existed before the priority date of each claim of this application.

BRIEF DESCRIPTION OF THE DRAWINGS

The features and advantages of the disclosure will become apparent from a consideration of the subsequent detailed description presented in connection with the accompanying drawings in which.

DETAILED DESCRIPTION

Figure 1:
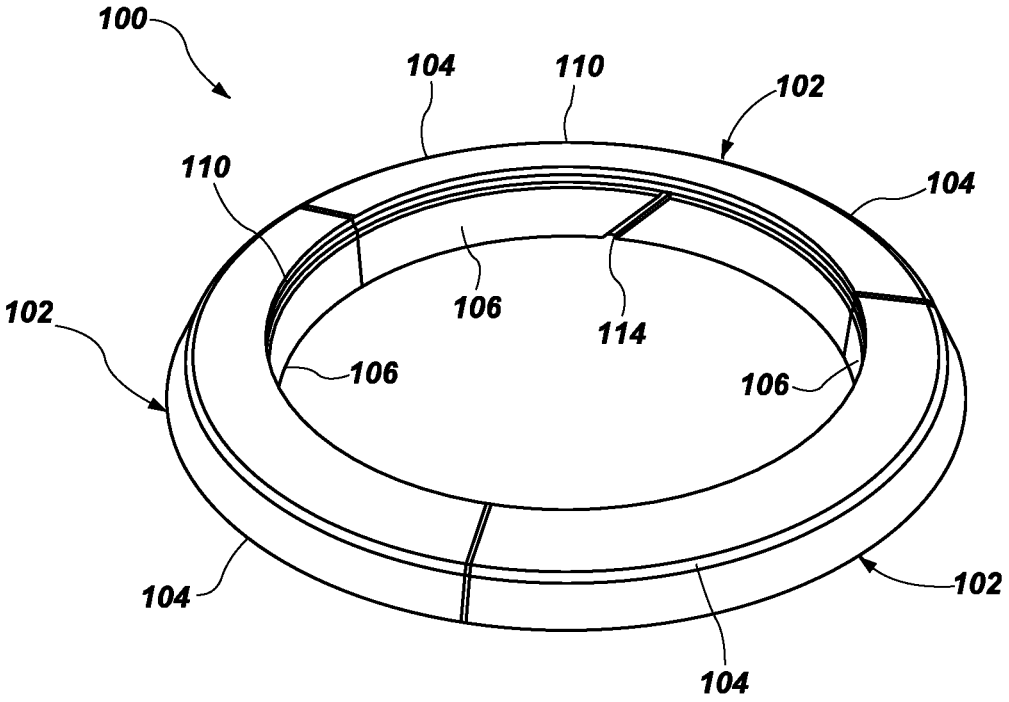
FIG. 1 is a perspective view of an embodiment of the disclosed invention.

For the purposes of promoting an understanding of the principles in accordance with the disclosure, reference will now be made to the embodiments illustrated in the drawings and specific language will be used to describe the same. It will nevertheless be understood that no limitation of the scope of the disclosure is thereby intended. Any alterations and further modifications of the inventive features illustrated herein, and any additional applications of the principles of the disclosure as illustrated herein, which would normally occur to one skilled in the relevant art and having possession of this disclosure, are to be considered within the scope of the disclosure claimed.

Before the present apparatus and methods for providing a lighted reinforced landscape structure disclosed and described, it is to be understood that this disclosure is not limited to the particular configurations, process steps, and materials disclosed herein as such configurations, process steps, and materials may vary somewhat. It is also to be understood that the terminology employed herein is used for the purpose of describing particular embodiments only and is not intended to be limiting since the scope of the present disclosure will be limited only by the appended claims and equivalents thereof.

The publications and other reference materials referred to herein to describe the background of the disclosure, and to provide additional detail regarding its practice, are hereby incorporated by reference herein in their entireties, with the following exception: In the event that any portion of said reference materials is inconsistent with this application, this application supercedes said reference materials. The reference materials discussed herein are provided solely for their disclosure prior to the filing date of the present application. Nothing herein is to be construed as a suggestion or admission that the inventors are not entitled to antedate such disclosure by virtue of prior disclosure, or to distinguish the present disclosure from the subject matter disclosed in the reference materials.

It must be noted that, as used in this specification and the appended claims, the singular forms "a," "an," and "the" include plural referents unless the context clearly dictates otherwise. Moreover, as used herein, the terms "comprising," "including," "containing," "characterized by," and grammatical equivalents thereof are inclusive or open-ended terms that do not exclude additional, unrecited elements or method steps.

As used herein, the term "elongate" shall be construed broadly to include structures that have one dimension, such as a length, that is greater than another dimension, such as a width or diameter.

As used herein, the term "ground" or surrounding ground" shall be construed broadly to include any surface upon which a device or apparatus is placed, providing support or a foundation for said device or apparatus, including but not limited to: sand soil, grass, mulch, pavement, gravel, turf or any other desired surface.

As used herein, the term "proximal" shall refer broadly to the concept of a nearest portion. For example, the vertical adjustment is the proximal-most portion of the shank, because it is the nearest portion when said shank is installed.

As used herein, the term "distal" shall generally refer to the opposite of proximal, and thus to the concept of a further portion, or a furthest portion, depending upon the context.

The following inventive embodiments are related to a lighted reinforced landscape structure. The functional appeal of curbing and flatwork can be enhanced significantly by projecting a continuous beam of light along the curbing or flatwork. In presently disclosed embodiments, the disclosed curbing includes one or more elongate channels formed therein, and the lighting is separately sheathed and removably disposed in the channel to produce a continuous beam of light along the curbing. The lighting preferably comprises a sequence of small, closely-spaced light bulbs disposed in a flexible translucent or transparent sheath, and the lighting thereby resembles a rope. Other sources of light may be utilized in lieu of bulbs, such as solar-power devices, laser-light devices, or light-emitting fibers such as glass fibers, plastic fibers, or any other suitable device capable of producing light.

Referring now to FIGS. 1-8*c*, there is shown one embodiment of the invention, in the form of lighted landscape structure or assembly 100 including a plurality of interlocking curbing sections 102, forming a generally circular shape. While a generally circular shape of the landscape structure 100 is shown in FIG. 1, the landscape structure may also be formed of alternative shapes, such as square, rectangular, triangular, ovular, or any other desired shape.

Each curbing section 102 may be substantially hollow, having a generally convex front surface 104 connected with a substantially planar rear surface 106, forming an interior cavity 108 formed by the front surface 104 and the rear surface 106, with the understanding that each curbing section 102 may instead be constructed to be non-hollow or solid, in an alternative embodiment. Each curbing section 102 may have a width of 2"-2', or 7" or any other desired width greater than or less than 7". Each curbing section 102 may also have a height of 2"-2', or 5" or any other desired height greater than or less than 5". The rear surface 106 may include a channel 110 integrally formed therein, said channel 110 extending along the entire length of each curbing section 102. The channel 110 may have a width w of 0.25"-2", or 0.6" or any other desired width greater than or less than 0.6". The channel 110 may have a depth d of 0.25"-2", or 0.4" or any other desired width greater than or less than 0.4". Each curbing section 102 may have an interior radius of curvature I and an outer radius of curvature O, where the interior radius of curvature I may be 6"-6', or 18" or another desired range, greater or smaller than 18". The outer radius of curvature O may be 3"-7', or 25" or another desired range, greater or smaller than 25".

Channels 110 of each curbing section are positioned at the same relative location on each of the curbing sections such that, when the curbing sections are assembled together, a single continuous channel 110 is formed by the combination of each curbing section 102. The landscape assembly 100 may also include a light source 112 which can be positioned, fixed or disposed in the channel 110, providing a recessed lighting configuration with respect to the rear surface 106. For example, the light source can be adhered to at least one of the sidewalls forming the channel 110, or removably connected to the channel via any suitable fastener, tape, glue or other fastening device or mechanism.

The light source 112 may include an elongate, flexible rope-type light source (i.e. a rope light), or any other desired lighting mechanism. The light source 112 may be powered via a battery, a solar power source, or another suitable remote power source (not shown). The light source 112 may comprise any suitable device for producing light, including a plurality of bulbs, a solar powered device as known in the art, or LED, or a laser light device as known in the art, or light-emitting fibers as known in the art, including flexible glass fibers, flexible plastic fibers, or any other suitable type of light-emitting fiber as known in the art.

Each curbing section may also include an connecting channel 114 which is formed in the rear surface 106 and intersects with channel 110, providing recessed access to the channel 110 from the surrounding ground or from the interior cavity 108. The connecting channel 114 may form an angle θ with a bottom surface of the curbing section 102. The angle angle θ may by 20-90 degrees, or may be 50 degrees or another desired angle greater than or less than 50 degrees. Thus, the light source 112, or a power cord connected to the light source 112, may be positioned, fixed or disposed in the connecting channel 114, providing a recessed lighting configuration with respect to the rear surface 106. For example, the light source 112 may be adhered to at least one of the sidewalls forming the connecting channel 114, or removably connected to the channel 114 via any suitable fastener, tape, glue or other fastening device or mechanism.

Figure 5A:
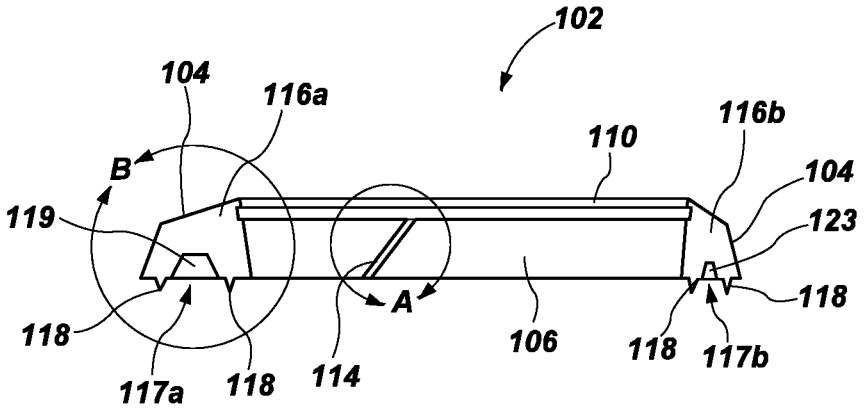
FIG. 5*a* is a side view of a curbing section of the embodiment of FIG. 1.
Figure 5B:
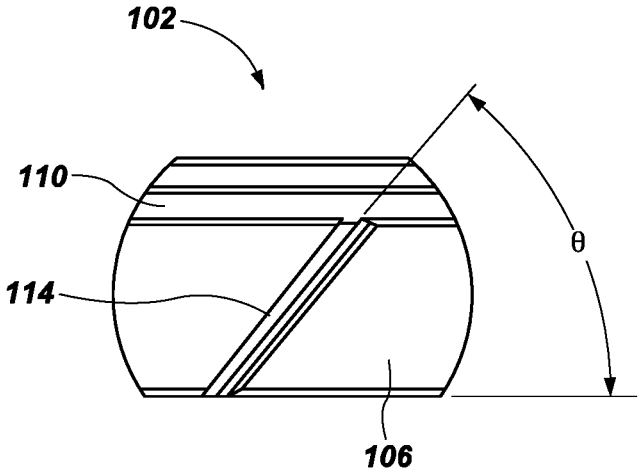
FIG. 5*b* is a zoomed in view of section A of the embodiment of FIG. 5*a;*
Figure 5C:
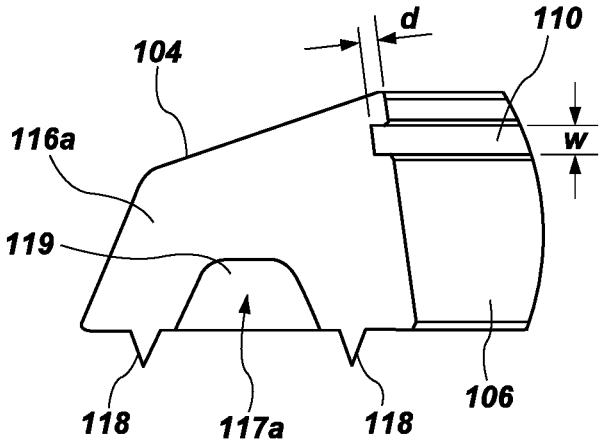
FIG. 5*c* is a zoomed in view of section B of the embodiment of FIG. 5*a;*
Figure 6A:
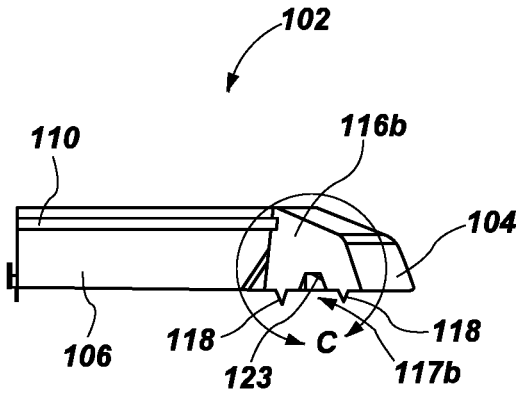
FIG. 6*a* is another side view of a curbing section of the embodiment of FIG. 1.
Figure 6B:
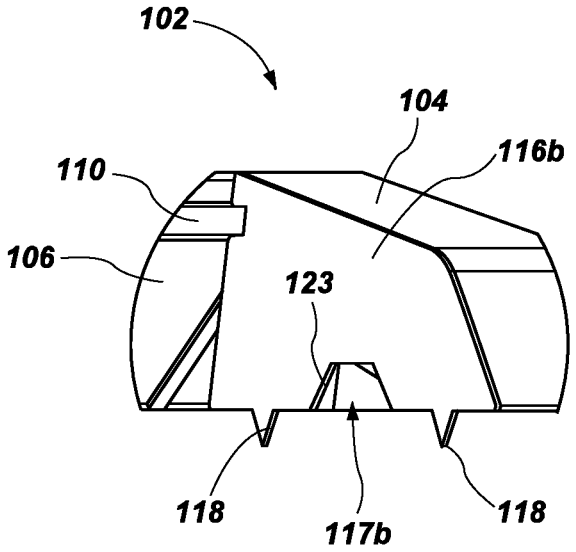
FIG. 6*b* is a zoomed in view of section C of the embodiment of FIG. 6*a;*

As shown in FIGS. 1 and 5*a*-5*b*, the connecting channel 114 may be angled with respect to the channel 110, for example, the connecting channel 114 and channel 110 may form a 50 degree angle, a 90 degree angle, a 30 degree angle or an angle between 30 and 90 degrees. The angle formed by the connecting channel 114 and the channel 110 may increase the ease of mounting and positioning the light source within the channel 110 and connecting channel 114, while limiting any potential kinking of the light source 112 as it extends through the connecting channel 114 and the channel 110.

Each curbing section 102 may also include a pair of end walls 116*a* and 116*b*, which may be substantially planar and substantially vertical with respect to the surrounding ground. The end walls 116*a* and 116 may be connected to the front surface 104 and the rear surface 106, further enclosing the interior cavity 108. End walls 116*a* and 116*b* respectively include interlocking engagement features 117*a* and 117*b* disposed thereon, such that the engagement features 117*a* and 117*b* constitute a set of interlocking engagement features 117*a* and 117*b*. The set of interlocking engagement features 117*a* and 117*b* enable adjacent curbing sections to be releasably connected to one another.

As shown in FIGS. 5*a*-8*c*, engagement feature 117*a* may include a protrusion extending away from the end wall 116*a*, the protrusion including a head 119 and a neck 121, the neck extending away from the end wall 116*a* and the head 119 disposed on the neck 121. The head 119 may have a greater cross-sectional area in a substantially vertical plane than the neck 121. The head 119 may be shaped or configured to have a generally trapezoidal shape such that at least one side is immediately adjacent to the ground when in use, although any other desired shape may also be used. The neck 121 may have the same general shape as the head 119, such as a generally trapezoidal shape, or any other desired shape may be used. The head 119 and neck 121 of the engagement feature 117*a* may be received by engagement feature 117*b* which may be a cutout, or slot formed in the end wall 116*b*, which may releasably retain engagement feature 117*a*. The slot 117*b* may be defined by an internal surface 123 in the end wall 116*b*. The slot 117*b* may have the same general shape as the neck 121, such that the slot 117*b* creates a friction, interference, or press fit with the neck 121, when the neck 121 is engaged with the slot 117*b*. For example, when engaged, the neck 121 may have three sides in contact with the slot 117*b*, or as another example, the neck 121 may be in contact with the internal surface 123 defining slot 117*b*, over substantially 180 degrees. In another example, the internal surface 123 of the slot 121 may surround, engage or contact, 20-100% of a circumference of the neck 121 when in interlocking engagement with an immediately adjacent curbing section 102, or the internal surface 123 of the slot 121 may surround, engage or contact 30-90%, 40-80%, 60-80%, 20-40%, or at least 50% of a circumference of the neck 121, or any other desired suitable percentage of a circumference of neck 121, when in interlocking engagement with an immediately adjacent curbing section 102. Stated another way, the internal surface 123 may surround at least 180 degrees of the neck 121 or any other desired percentage of a circumference of neck 121, when in interlocking engagement with an immediately adjacent curbing section 102. In additional embodiments, not shown in the figures, the neck 121 and slot 123 may have different shapes and may be more or fewer sides in contact with one another. In other embodiments, not shown, engagement features 117*a* and 117*b* may include any device, feature or mechanism that can releasably connect adjacent curbing sections 102 to one another, to form a continuous landscape structure.

As shown in FIGS. 5*a*-6*b*, end walls 116*a* and 116*b* may also include a plurality, or pair, of ground spikes 118 or protrusions extending substantially vertically, or downward, from the end wall surfaces 116*a* and 116*b*. Each spike 118 may have a length l of 0.25"-3", or 0.75" or any other desired length greater than or less than 0.75". The spikes 118 may form a taper, terminating at a point, to facilitate easy insertion of the spikes into the ground and then maintaining the position of the curbing section 102 with respect to the surrounding ground, by restricting or limiting lateral movement of the curbing section 102 while the spikes 118 are inserted in the surrounding ground. The spikes 118 may be formed as a single unitary piece with respect to the corresponding end walls 116*a* and 116*b* or the spike 118 may be disposed on, connected, fastened, adhered to, or releasably attached to the corresponding end walls 116*a* and 116*b*. The end walls 116*a* and 116*b* may alternatively include just a single spike, or any other number of desired spikes.

Figure 2:
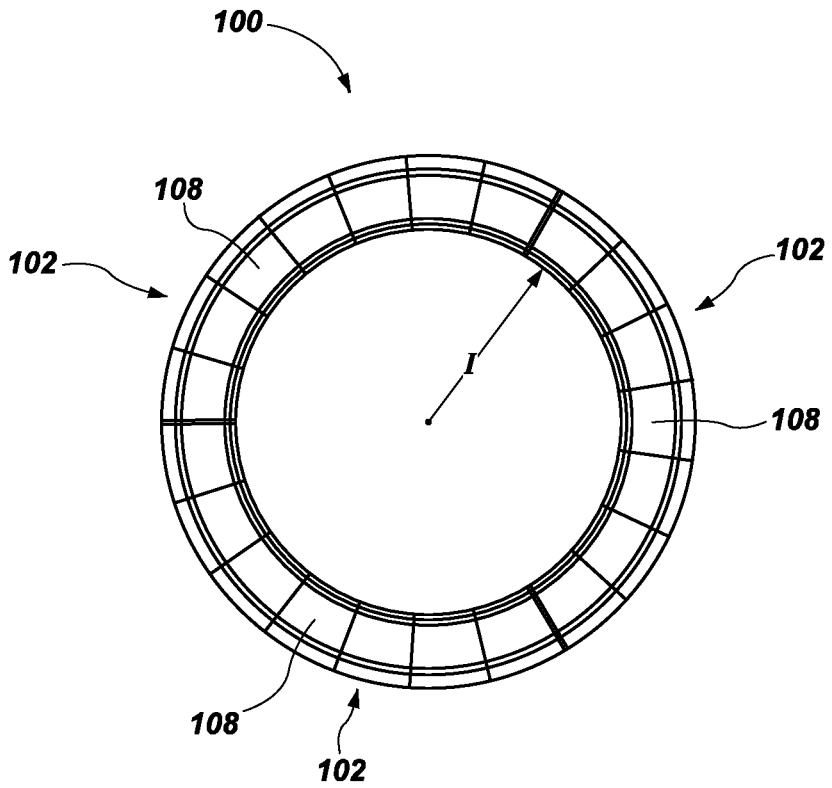
FIG. 2 is a bottom view of the embodiment of FIG. 1.
Figure 3:
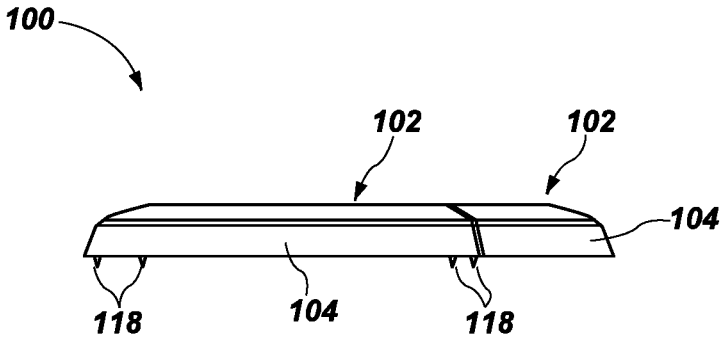
FIG. 3 is a side view of the embodiment of FIG. 1.
Figure 4:
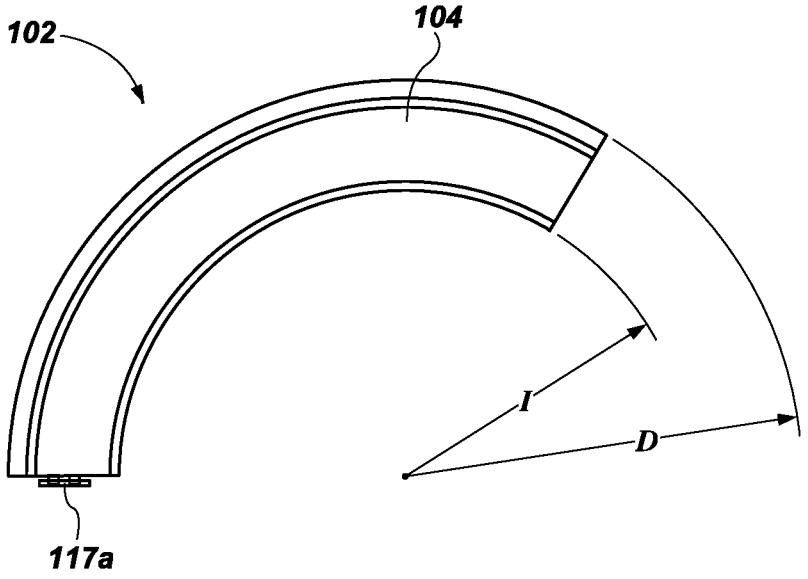
FIG. 4 is a top view of a curbing section of the embodiment of FIG. 1.
Figure 7A:
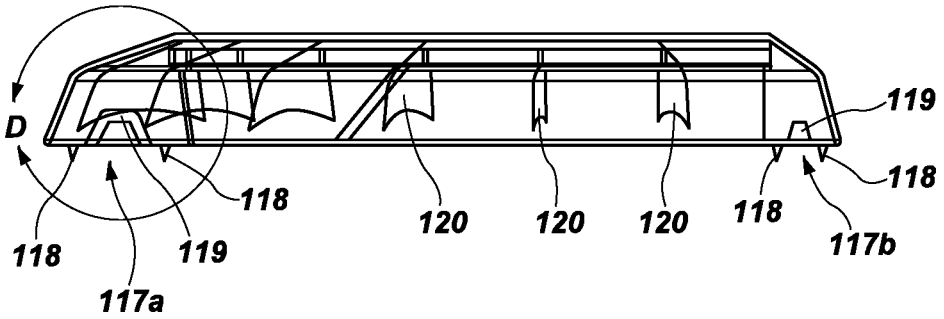
FIG. 7*a* is another side view of a curbing section of the embodiment of FIG. 1, shown with transparent elements and surfaces.
Figure 7B:
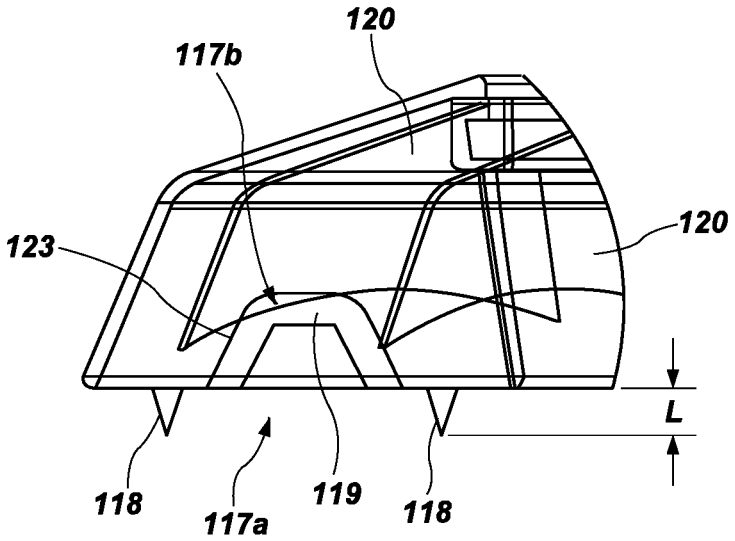
FIG. 7*b* is a zoomed in view of section D of the embodiment of FIG. 7*a;*

As shown in FIGS. 2 and 7*a*-7*b*, each curbing section 102 may also include a plurality of supports 120, which can be configured as substantially vertical braces or supports which contact and provide vertical and radial support to the front and rear surfaces 104 and 106. Each support 120 is positioned and retained within the interior cavity 108, such that each support 120 can directly contact interior sides of the front and rear surfaces 104 and 106, although indirect contact, in other embodiments, may be made while still providing significant vertical and radial support of the front and rear surfaces. The supports 120 may be connected, fixed or positioned within the interior cavity 108 at uniform spaced intervals, thereby providing rigid vertical and radial support throughout the length of each of the curbing sections. The supports 120 may be integral (as a single piece) with the interior sides of the front and rear surfaces 104 and 106, or may be attached or connected thereto.

Figure 8A:
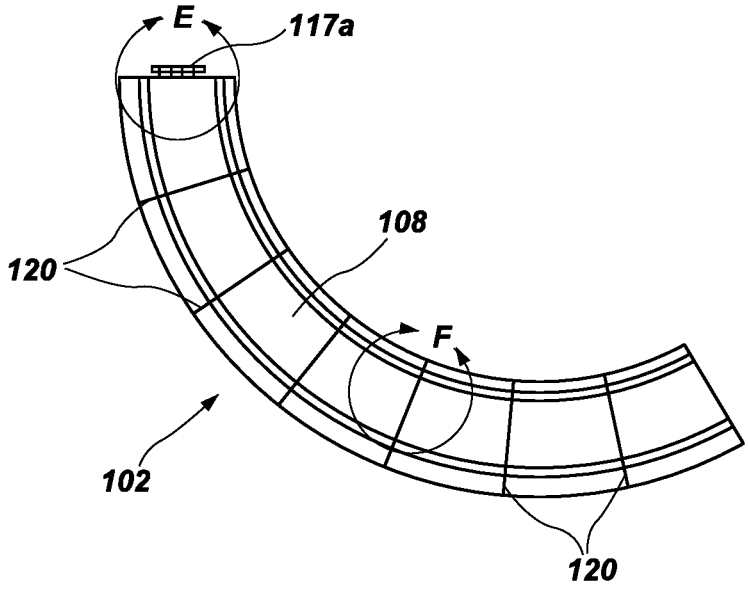
FIG. 8*a* is a bottom view of a curbing section of the embodiment of FIG. 1.
Figure 8B:
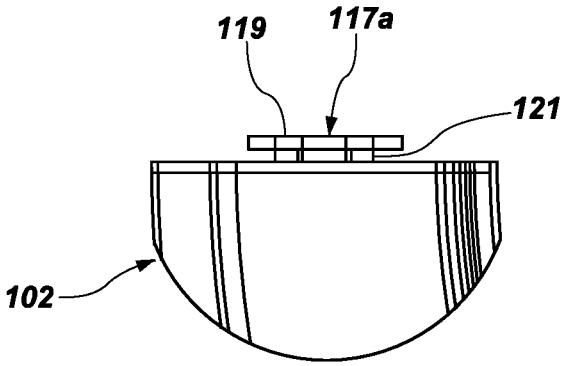
FIG. 8*b* is a zoomed in view of section F of the embodiment of FIG. 8*a*.
Figure 8C:
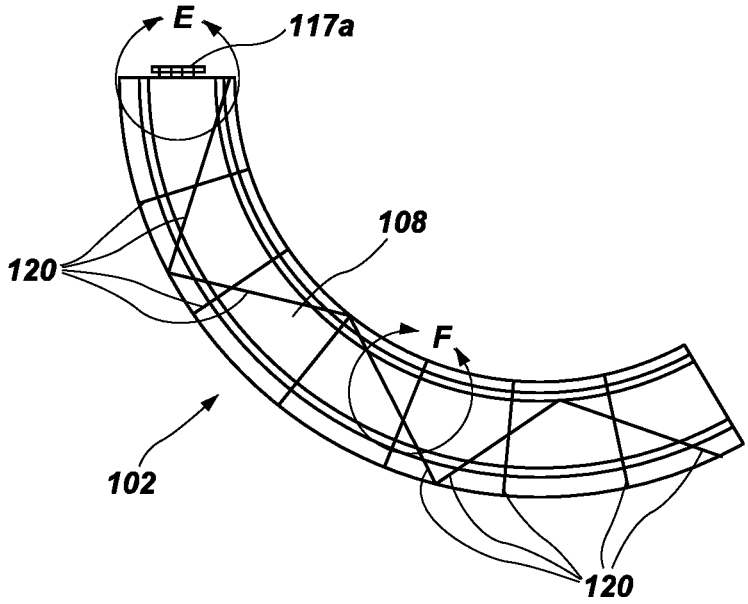
FIG. 8*c* is a bottom view of a curbing section of another disclosed embodiment.

In alternative embodiments, such as the embodiment shown in FIG. 8*c*, the supports 120 may intersect or cross with one another within the interior cavity 108 while still maintaining vertical and radial support to the front and rear surfaces 104 and 106.

Each of the curbing sections 102 including all structural components thereof, including, the front and rear surfaces 104 and 106, channels 110 and 114, engagement features 117*a* and 117*b*, spikes 118, and supports 120, may be made of plastic or any other suitable material, which can be used to injection mold each curbing section 102 as a single unitary piece. The curbing sections 102 may also be made of a durable plastic material using any suitable desired manufacturing process, such as, but not limited to, 3D printing, blow molding, compression molding, foam molding, thermoforming, or any other suitable desired molding or manufacturing process. Alternatively, the curbing section may be made of another desired material or combination of materials, such as, for example, metal, concrete, wood, rubber, or other desired materials.

It is to be understood that the principles of the present disclosure, support any method of making or manufacturing curbing section 102, including, but not limited to, injection molding, molding methods not including injection molding, 3D printing, casting, welding, gluing, fastening or joining together multiple preexisting parts to thereby form a one-piece or unitary structure constituting curbing section 102.

In the foregoing Detailed Description, various features of the present disclosure are grouped together in a single embodiment for the purpose of streamlining the disclosure. This method of disclosure is not to be interpreted as reflecting an intention that the claimed disclosure requires more features than are expressly recited in each claim. Rather, as the following claims reflect, inventive aspects lie in less than all features of a single foregoing disclosed embodiment. Thus, the following claims are hereby incorporated into this Detailed Description of the Disclosure by this reference, with each claim standing on its own as a separate embodiment of the present disclosure.

It is to be understood that the above-described arrangements are only illustrative of the application of the principles of the present disclosure. Numerous modifications and alternative arrangements may be devised by those skilled in the art without departing from the spirit and scope of the present disclosure and the appended claims are intended to cover such modifications and arrangements. Thus, while the present disclosure has been shown in the drawings and described above with particularity and detail, it will be apparent to those of ordinary skill in the art that numerous modifications, including, but not limited to, variations in size, materials, shape, form, function and manner of operation, assembly and use may be made without departing from the principles and concepts set forth herein.

What is claimed is:

1. A landscape assembly comprising:

a plurality of curbing sections, each curbing section including:

a front surface and a rear surface forming an interior cavity;

a plurality of supports positioned within the interior cavity and providing vertical and radial support to the front and rear surfaces;

a channel integral with the rear surface and extending along an entire length of the curbing section;

a first end wall connected to a first terminating end of the front and rear surfaces;

a second end wall connected to a second terminating end of the front and rear surfaces, the first and second end walls enclosing the interior cavity;

a plurality of spikes extending substantially downward from the curbing section; and each of the plurality of curbing sections having a set of interlocking engagement features comprising: a first interlocking engagement feature and a second interlocking engagement feature disposed on the first and second end walls, respectively, said set of interlocking engagement features being configured to interlock one of the plurality of curbing sections with an immediately adjacent curbing section.

2. A landscape assembly of claim 1, wherein the plurality of spikes are integrally formed with the curbing section.

3. A landscape assembly of claim 1, wherein the interlocking engagement features are integrally formed with the curbing section.

4. A landscape assembly of claim 1, wherein each of the plurality of curbing sections are made of plastic.

5. A landscape assembly of claim 4, wherein each of the plurality of curbing sections are injection molded.

6. A landscape assembly of claim 1, further comprising:

a light source positioned within the channel of each of the plurality of curbing sections.

7. A landscape assembly of claim 6, wherein the light source is a rope light.

8. A landscape assembly of claim 1, wherein each set of the interlocking engagement features include at least one slot and one protrusion, such that each slot is defined by an internal surface configured to receive a protrusion from an immediately adjacent curbing section.

9. A landscape assembly of claim 8, wherein each internal surface surrounds at least 50% of a circumference of the protrusion of the immediately adjacent curbing section.

10. A landscape assembly of claim 8, wherein each internal surface engages at least 50% of a circumference of the protrusion of the immediately adjacent curbing section.

11. A landscape assembly of claim 1, wherein each of the plurality of curbing sections are separately formed as a single unitary piece.

12. A landscape assembly comprising:

a plurality of curbing sections, each curbing section including:

a front surface and a rear surface forming an interior cavity;

a plurality of supports positioned within the interior cavity and providing vertical and radial support to the front and rear surfaces;

a channel integral with the rear surface and extending along an entire length of the curbing section;

a light source positioned within the channel;

a first end wall connected to a first terminating end of the front and rear surfaces;

a second end wall connected to a second terminating end of the front and rear surfaces, the first and second end walls enclosing the interior cavity;

each of the plurality of curbing sections having interlocking engagement features connected to the first and second end walls, configured to interlock one of the plurality of curbing sections with an immediately adjacent curbing section.

13. A landscape assembly of claim 12, wherein the plurality of spikes are integrally formed with the curbing section.

14. A landscape assembly of claim 12, wherein the interlocking engagement features are integrally formed with the curbing section.

15. A landscape assembly of claim 12, wherein each of the plurality of curbing sections are made of plastic.

16. A landscape assembly of claim 15, wherein each of the plurality of curbing sections are injection molded.

17. A landscape assembly of claim 12, wherein the light source is a rope light.

18. A landscape assembly of claim 12, wherein each set of the interlocking engagement features include at least one slot and one protrusion, such that each slot is defined by an internal surface configured to receive a protrusion from an immediately adjacent curbing section.

19. A landscape assembly of claim 18, wherein each internal surface surrounds at least 50% of a circumference of the protrusion of the immediately adjacent curbing section.

20. A landscape assembly of claim 18, wherein each internal surface engages at least 50% of a circumference of the protrusion of the immediately adjacent curbing section.

21. A landscape assembly of claim 12, wherein each of the plurality of supports are integral with the curbing section.

22. A landscape assembly of claim 12, wherein the interlocking engagement features disposed on the first and second end walls of immediately adjacent curbing sections, interlock via an friction fit.

23. A landscape assembly of claim 12, wherein each of the plurality of curbing sections are separately formed as a single unitary piece.

24. A landscape assembly comprising:

a plurality of curbing sections, each curbing section including:

a front surface and a rear surface forming an interior cavity;

a plurality of supports positioned within the interior cavity and providing vertical and radial support to the front and rear surfaces;

a channel integral with the rear surface and extending along an entire length of the curbing section;

a first end wall connected to a first terminating end of the front and rear surfaces;

a second end wall connected to a second terminating end of the front and rear surfaces, the first and second end walls enclosing the interior cavity;

a plurality of spikes extending downward from the curbing section;

each of the plurality of curbing sections having a set of interlocking engagement features comprising: a first interlocking engagement feature and a second interlocking engagement feature disposed on the first and second end walls, respectively, said set of interlocking engagement features being configured to interlock one of the plurality of curbing sections with an immediately adjacent curbing section; and wherein each of the curbing sections is injection molded.

25. A landscape assembly of claim 24, wherein the plurality of spikes are integrally formed with the curbing section.

26. A landscape assembly of claim 24, wherein the interlocking engagement features are integrally formed with the curbing section.

27. A landscape assembly of claim 24, wherein each of the plurality of curbing sections are made of plastic.

28. A landscape assembly of claim 27, wherein each of the plurality of curbing sections are injection molded.

29. A landscape assembly of claim 24, further comprising:

a light source disposed within the channel of each of the plurality of curbing sections.

30. A landscape assembly of claim 29, wherein the light source is a rope light.

31. A landscape assembly of claim 29, wherein each of the plurality of curbing sections having a set of interlocking engagement features comprising: a first interlocking engagement feature and a second interlocking engagement feature disposed on the first and second end walls, respectively, said set of interlocking engagement features being configured to interlock one of the plurality of curbing sections with an immediately adjacent curbing section.

32. A landscape assembly of claim 31, wherein the interlocking engagement features are integrally formed with the curbing section.

33. A landscape assembly of claim 31, wherein each set of the interlocking engagement features include at least one slot and one protrusion, such that each slot is defined by an internal surface configured to receive a protrusion from an immediately adjacent curbing section.

34. A landscape assembly of claim 33, wherein each internal surface surrounds at least 50% of a circumference of the protrusion of the immediately adjacent curbing section.

35. A landscape assembly of claim 33, wherein each internal surface engages at least 50% of a circumference of the protrusion of the immediately adjacent curbing section.

36. A landscape assembly of claim 31, wherein the interlocking engagement features disposed on the first and second end walls of immediately adjacent curbing sections, interlock via a friction fit.

37. A landscape assembly of claim 24, wherein each set of the interlocking engagement features include at least one slot and one protrusion, such that each slot is defined by an internal surface configured to receive a protrusion from an immediately adjacent curbing section.

38. A landscape assembly of claim 37, wherein each internal surface surrounds at least 50% of a circumference of the protrusion of the immediately adjacent curbing section.

39. A landscape assembly of claim 37, wherein each internal surface engages at least 50% of a circumference of the protrusion of the immediately adjacent curbing section.

40. A landscape assembly of claim 24, wherein the interlocking engagement features disposed on the first and second end walls of immediately adjacent curbing sections, interlock via an interference fit.

41. A landscape assembly of claim 24, wherein each of the plurality of curbing sections are separately formed as a single unitary piece.

42. A landscape assembly comprising:

a plurality of curbing sections, each curbing section including:

a front surface and a rear surface forming an interior cavity;

a plurality of supports positioned within the interior cavity and providing vertical and radial support to the front and rear surfaces;

a channel integral with the rear surface and extending along an entire length of the curbing section;

a first end wall connected to a first terminating end of the front and rear surfaces;

a second end wall connected to a second terminating end of the front and rear surfaces, the first and second end walls enclosing the interior cavity;

a light source positioned within the channel; and wherein each of the curbing sections is injection molded.

43. A landscape assembly of claim 42, wherein each of the plurality of curbing sections are made of plastic.

44. A landscape assembly of claim 42, further comprising:

a plurality of spikes extending substantially downward from each of the plurality of curbing sections.

45. A landscape assembly of claim 44, wherein the plurality of spikes are integrally formed with the curbing section.

46. A landscape assembly of claim 42, wherein the light source is a rope light.

47. A landscape assembly of claim 42, wherein each of the plurality of curbing sections are separately formed as a single unitary piece.

48. A landscape assembly comprising:

a plurality of curbing sections, each curbing section including:

a front surface and a rear surface forming an interior cavity;

a plurality of supports positioned within the interior cavity and providing vertical and radial support to the front and rear surfaces;

a channel integral with the rear surface and extending along an entire length of the curbing section;

a first end wall connected to a first terminating end of the front and rear surfaces;

a second end wall connected to a second terminating end of the front and rear surfaces, the first and second end walls enclosing the interior cavity; and each of the plurality of curbing sections having a set of interlocking engagement features comprising: a first interlocking engagement feature and a second interlocking engagement feature disposed on the first and second end walls, respectively, said set of interlocking engagement features being configured to interlock one of the plurality of curbing sections with an immediately adjacent curbing section.

49. A landscape assembly of claim 48, further comprising:

a plurality of spikes extending substantially downward from each of the plurality of curbing sections.

50. A landscape assembly of claim 48, wherein the interlocking engagement features disposed on the first and second end walls of immediately adjacent curbing sections, interlock via an interference fit.

51. A landscape assembly of claim 48, wherein each set of the interlocking engagement features include at least one slot and one protrusion, such that each slot is defined by an internal surface configured to receive a protrusion from an immediately adjacent curbing section.

52. A landscape assembly of claim 51, wherein each internal surface surrounds at least 50% of a circumference of the protrusion of the immediately adjacent curbing section.

53. A landscape assembly of claim 51, wherein each internal surface engages at least 50% of a circumference of the protrusion of the immediately adjacent curbing section.

54. A landscape assembly of claim 48, wherein the interlocking engagement features disposed on the first and second end walls of immediately adjacent curbing sections, interlock via a friction fit.

55. A landscape assembly comprising:

a plurality of curbing sections, each curbing section including:

a front surface and a rear surface forming an interior cavity;

a plurality of supports positioned within the interior cavity and providing vertical and radial support to the front and rear surfaces;

a channel integral with the rear surface and extending along an entire length of the curbing section;

a first end wall connected to a first terminating end of the front and rear surfaces;

a second end wall connected to a second terminating end of the front and rear surfaces, the first and second end walls enclosing the interior cavity;

a plurality of spikes extending substantially downward from the curbing section, wherein the plurality of spikes are integrally formed with the curbing section;

each of the plurality of curbing sections having a set of interlocking engagement features comprising: a first interlocking engagement feature and a second interlocking engagement feature disposed on the first and second end walls, respectively, said set of interlocking engagement features being configured to interlock one of the plurality of curbing sections with an immediately adjacent curbing section;

wherein the interlocking engagement features are integrally formed with the curbing section;

wherein each of the plurality of curbing sections are made of plastic and are injection molded;

a light source positioned within the channel of each of the plurality of curbing sections, wherein the light source is a rope light.

wherein each set of the interlocking engagement features include at least one slot and one protrusion, such that each slot is defined by an internal surface configured to receive a protrusion from an immediately adjacent curbing section, and each internal surface engages at least 50% of a circumference of the protrusion of the immediately adjacent curbing section; and wherein each of the plurality of curbing sections are separately formed as a single unitary piece.

* * * * *